US008307509B2

(12) United States Patent
Schau

(10) Patent No.: US 8,307,509 B2
(45) Date of Patent: Nov. 13, 2012

(54) HINGE WITH ELECTRICAL WIRING

(75) Inventor: Timothy Alan Schau, Portage, MI (US)

(73) Assignee: Select Products Ltd, Portage, MI (US)

( * ) Notice: Subject to any disclaimer, the term of this patent is extended or adjusted under 35 U.S.C. 154(b) by 358 days.

(21) Appl. No.: 12/378,616

(22) Filed: Feb. 18, 2009

(65) Prior Publication Data

US 2009/0313790 A1 Dec. 24, 2009

Related U.S. Application Data

(60) Provisional application No. 61/074,855, filed on Jun. 23, 2008.

(51) Int. Cl.
*E05D 7/00* (2006.01)

(52) U.S. Cl. ..... 16/354; 16/250; 439/31; 174/86

(58) Field of Classification Search ..... 16/354, 16/342, 366, 387, 2.1–2.2, 223, 250; 439/31, 439/165; 200/61.7; 361/679.28; 312/326; 160/229.1; 49/398; 174/86
See application file for complete search history.

(56) References Cited

U.S. PATENT DOCUMENTS

| | | | | |
|---|---|---|---|---|
| 612,192 | A | 10/1898 | Chandler | |
| 615,209 | A | 11/1898 | Baxter | |
| 2,688,733 | A | 9/1954 | Walter | |
| 2,778,000 | A | 1/1957 | Mills | |
| 3,402,422 | A * | 9/1968 | Baer | 16/366 |
| 3,659,063 | A | 4/1972 | Peterson | |
| 3,838,234 | A | 9/1974 | Peterson | |
| 3,842,386 | A | 10/1974 | Suska | |
| 3,857,625 | A | 12/1974 | Crane et al. | |
| 3,873,141 | A | 3/1975 | Peterson | |
| 4,116,514 | A | 9/1978 | Lawrence | |
| 4,140,357 | A | 2/1979 | Wolz et al. | |
| 4,412,711 | A | 11/1983 | Suska | |
| 5,001,810 | A * | 3/1991 | Baer | 16/302 |
| 5,201,902 | A * | 4/1993 | Baer | 16/354 |
| 5,337,451 | A * | 8/1994 | Goossens | 16/354 |
| 5,363,089 | A * | 11/1994 | Goldenberg | 340/7.63 |
| 5,727,960 | A | 3/1998 | Zehrung | |
| 7,063,042 | B2 | 6/2006 | Dillingham | |
| 7,316,376 | B1 * | 1/2008 | Engler | 248/218.4 |
| 7,824,200 | B2 * | 11/2010 | Bryla et al. | 439/165 |
| 2006/0021784 | A1 | 2/2006 | Garmong | |

* cited by examiner

*Primary Examiner* — William L. Miller
(74) *Attorney, Agent, or Firm* — Joseph K. Andonian

(57) ABSTRACT

A geared full surface mounted continuous hinge with a hole in a thrust bearing supporting the hinge, said hole adapted to accommodate a flexible tube containing electrical wiring and thereby facilitate the passage of electric current from a frame to appliances in a door connected to the frame using the hinge.

6 Claims, 9 Drawing Sheets

HINGE WITH ELECTRICAL WIRING

This application claims the benefit under 34 U.S.C. 119(e) of provisional application No. 61/074,855 filed Jun. 23, 2008 entitled "SURFACE MOUNTED GEAR HINGE WITH ELECTRICAL WIRING".

BACKGROUND OF THE INVENTION

Many buildings are equipped with doors that require transfer of electric power from the door frame to locks, latches, panic devices, alarms, cameras, I.D. readers and the like mounted on or in the door. The prior art provides examples of transfer of electrical power through knuckle hinges (hereinafter referred to as butt hinges) such as those described in U.S. Pat. Nos. 3,838,234; 3,84286; and 4,412,711. U.S. Pat. No. 7,063,042 provides an example of electrical transfer through a continuous gear butt hinge, not a surface mounted hinge.

A butt hinge is largely hidden from view when a door employing the hinge is closed. In contrast a surface mounted hinge is almost fully visible. An example of electrical transfer through a surface mounted continuous gear hinge can be found at the Pemko website. The Pemko product passes electricity through a flat cable that passes through a cutout in a portion of the gears.

SUMMARY OF THE INVENTION

The present invention is a geared surface mounted continuous door hinge with the capacity to provide a conduit for an electric current to pass from the frame in which a door is mounted to appliances in the door through a hole in a thrust bearing. Surface mounted hinges are generally employed as replacements for hinges on heavy doors and/or doors subject to heavy use after butt hinges originally installed with the doors no longer function effectively. Eventually heavy doors and heavy usage combine to cause the screws used to connect the small widely separated leaves of butt hinges to loosen and cause the doors to sag and close unevenly. Since the doors themselves are expensive enough to be worth retaining, it makes sense to replace the hinges rather than the doors. A surface mounted hinge is more durable than a butt hinge, especially when the leaves of a butt hinge are reconnected to the same worn locations in a frame as originally installed. In any case a continuous hinge spreads the load better than a butt hinge. Since doors often contain electrical devices, it is also necessary to find a way to deliver electric current from the building in which a door is mounted to appliances in the door.

The present invention differs from the prior art by passing electric wiring enclosed in a flexible tube through channels under the leaves and a hole in a thrust bearing employed in the hinge. The Pemko product passes electric wiring enclosed in a flat, flexible cable through a cutout in the gears employed in the hinge. This arrangement weakens the gears at the point where the cutout occurs. The Pemko design also employs a taller cap than that employed in the present invention to cover the cable and the gears, apparently to provide space for the cable. The taller cap prevents the door on which the Pemko hinge is installed from opening more than 150 degrees. In contrast the tube containing wiring in the present invention passes through a hole in a thrust bearing employed in the hinge. This arrangement permits the use of a cap with a lower profile that in turn allows a door on which the present invention is installed to open a full 180 degrees. The use of a flexible tube to enclose the wiring facilitates the passage of wiring through the hole in the bearing. Less exposure of the wiring also reduces wear and tear as well as the possibility of tampering. The character and advantages of the present invention will become more apparent in the following more detailed description.

The present invention consists essentially of a combination for providing a conduit for electrical wiring through a geared full surface continuous hinge adapted for attachment to the outside surfaces of a door and a frame in which the door is mounted. The combination comprises a door leaf and a frame leaf, each leaf having a plate segment and a plurality of geared segments interrupted by thrust bearing segments. The leaves are adapted to pivot around said bearings and meshed geared segments. More specifically the combination comprises (a) at least one thrust bearing having a hole aligned with holes in and channels under the hinge leaf plates, said holes and channels being large enough to allow a flexible tube containing electrical wires to pass sequentially into a first or outer round hole in the frame leaf plate, through the channel under that plate, out a second or inner oval hole in the frame leaf plate, through the hole in the thrust bearing, through a first or inner oval hole in the door leaf plate, through the channel under a door leaf plate and out a second or outer round hole in the door leaf plate, (b) a cap covering and holding the gears and bearings portions of the hinge together and extending for substantially the full length of the hinge and (c) covers extending for substantially the full length of the hinge over the first hole in frame leaf plate and the second hole of the door leaf plate. The covers over the leaf plates also cover the holes through which screws or bolts attach the leaves to the frame and door surfaces. Thus the wiring assembly is both substantially concealed and protected as it passes through the hinge without interfering with a full 180 degree operation of the door on which the hinge is attached. When the holes in the plates and wires are covered, they are also more secure and less subject to tampering, especially important when appliances in a door are designed to make the doors less accessible to unauthorized personnel.

LIST OF REFERENCE NUMERALS

Figure 1:
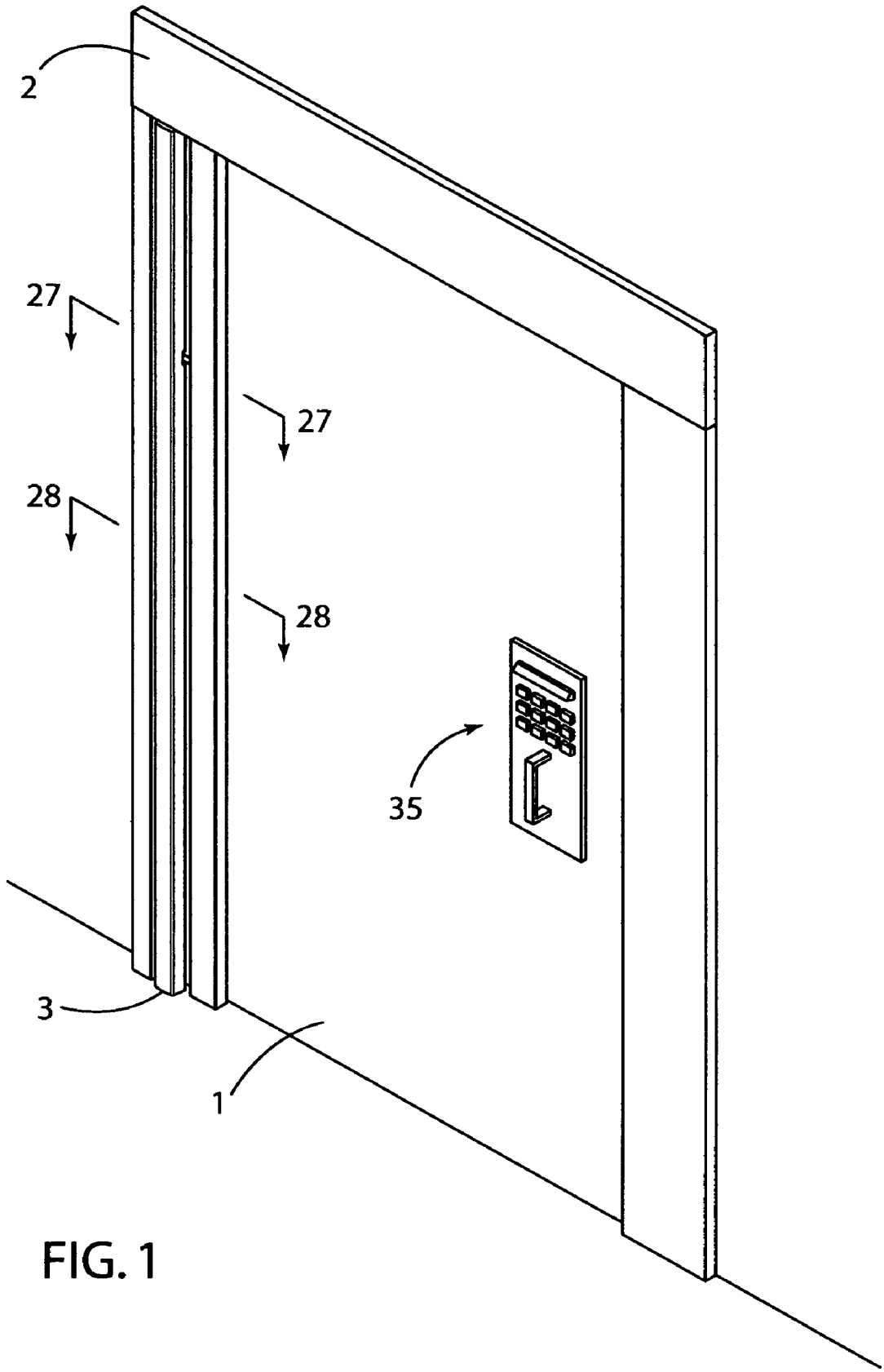
FIG. 1 is a front view of the surface mounted hinge of the present invention mounted on a door in a frame. An illustrative electrical appliance, namely a keypad for a door lock, is also shown in the door.

1 Door
2 Frame
3 Hinge
4 Frame leaf
5 Door leaf
6 Geared frame leaf plate
7 Geared door leaf plate
8 Gear
9 Thrust bearing with hole for wiring
10 Hole in thrust bearing
11 Round or outer hole in frame leaf plate
12 Oval or inner hole in frame leaf plate
13 Round or outer hole in door leaf plate
14 Oval or inner hole in door leaf plate
15 Tube for enclosing wiring
16 Wire(s)
17 Gear cap
18 Non-removable cover over frame leaf plate holes
19 Removable cover over door leaf plate holes
21 Set screw to hold the gear cap in place
22 Set screw to hold the removable door leaf plate cover in place
23*a*,23*b* Rails for frame leaf plate cover
24*a*,24*b* Rails for door leaf plate cover
25 Bolt holes in door leaf plate
26 Screw holes in frame leaf plate
27-27 Cross section showing wires passing through thrust bearing (see FIG. 2)
28-28 Cross section through geared portion of hinge (see FIG. 3)
29 Channel under frame leaf plate
30 Channel under door leaf plate
31 Plain thrust bearing (without hole)
32*a*,32*b* Projections on each end of thrust bearing
33*a*,33*b* Channels in thrust bearings for gear cap
34*a*,34*b* Clearance slots in gear cap for tube containing wiring
35 Key pad for door lock

DETAILED DESCRIPTION

The preferred embodiments of the present invention consist of the following components as more clearly shown in FIGS. 1-13:

(1) A full surface mount type geared aluminum or equivalent continuous door hinge 3 of any length.
(2) From one to 15 strands of 22 gauge flexible wire 16 in lengths of from 5 to 36 inches.
(3) From at least 1 to about 3 modified thrust bearings 9.
(4) PVC or equivalent flexible tubing 15 in a diameter suitable to pass through a hole 10 in the modified thrust bearings 9.
(5) A gear cap 17 to cover the meshed gears 8 and bearings 9,31 and two covers 18,19 to cover the machined holes 11,13,25,26 in the plates 6,7 of the leaves 4,5.

The essential equipment required to convert an ordinary geared continuous full surface hinge into the above embodiments include:

(1) A machine tool capable of repeatedly machining precision holes, channels and the like.
(2) Tooling capable of machining metals.
(3) Work holding fixtures.

Figure 2:
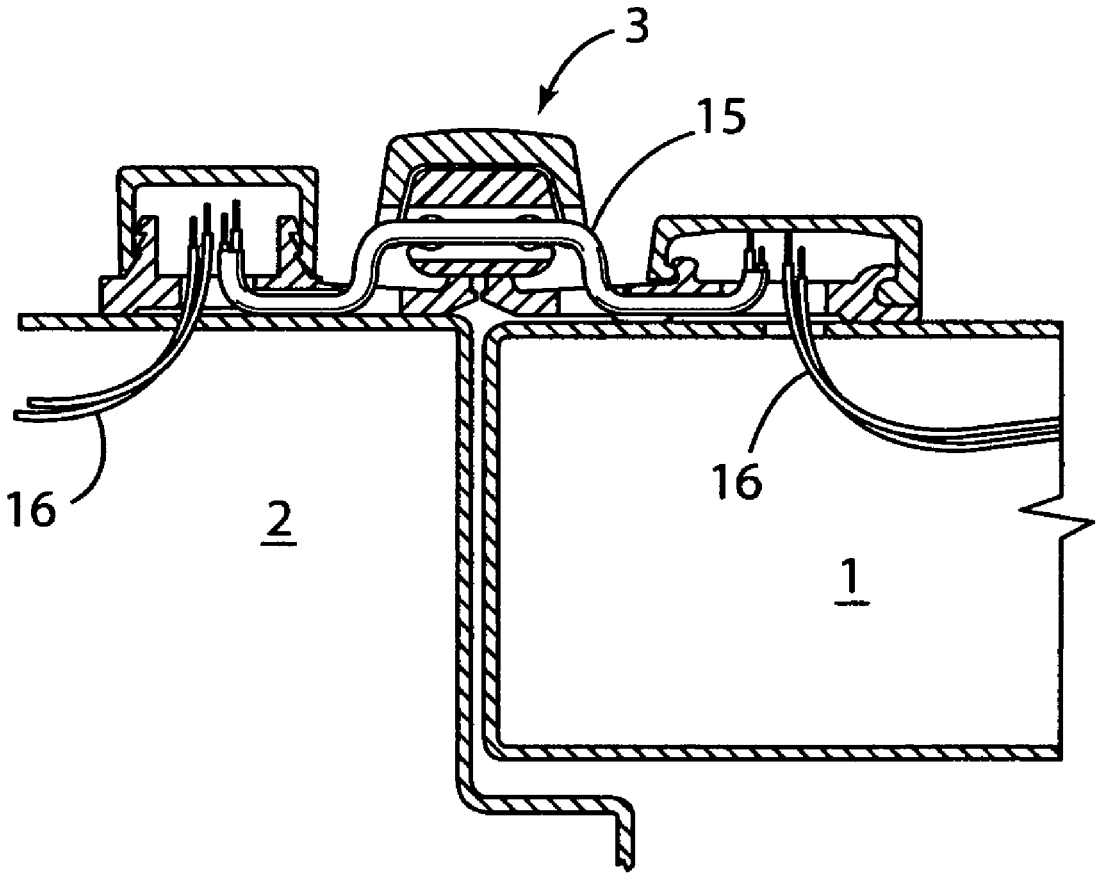
FIG. 2 is a sectional view taken along lines 27-27 of FIG. 1 showing electrical wiring passing through a thrust bearing and fragments of the door and frame.
Figure 3:
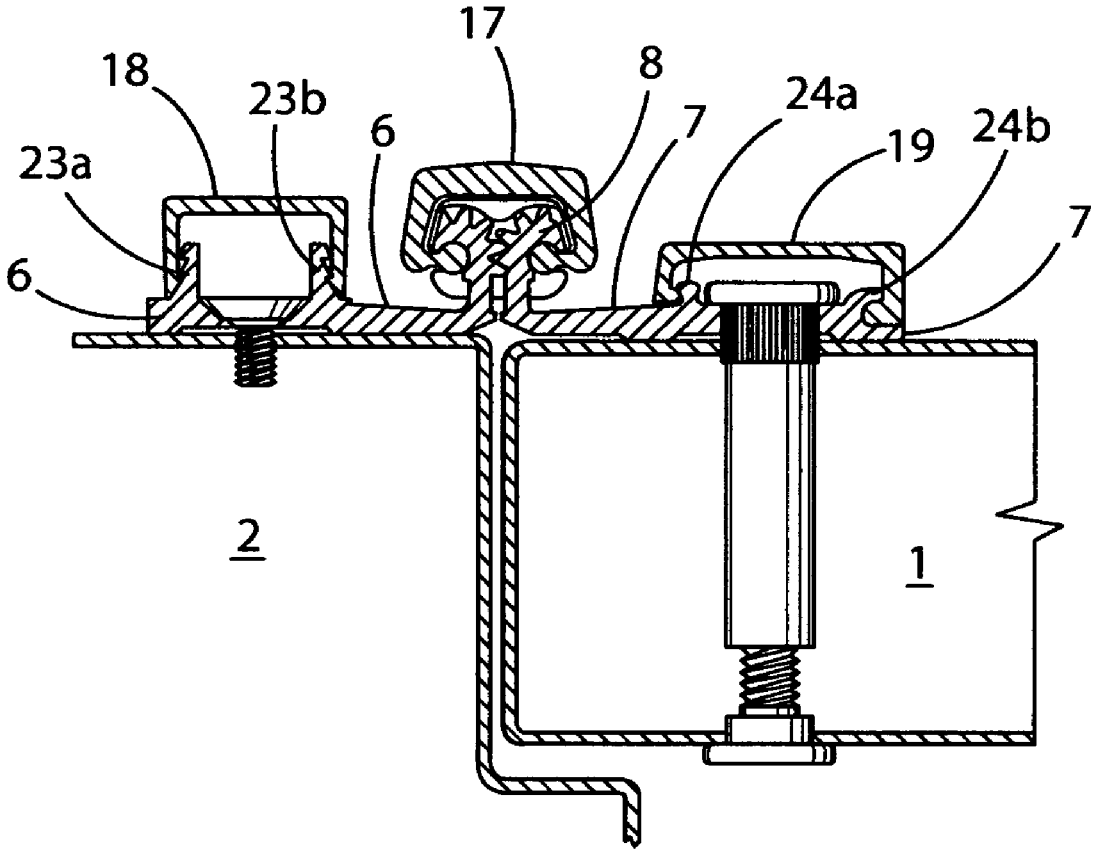
FIG. 3 is a sectional view taken along lines 28-28 of FIG. 1 through a geared portion of the hinge.

The work holding fixtures are employed to hold hinge components in place while the machine tool machines the hinge components necessary for wire installation using materials, equipment and procedures known to those skilled in this art. The hole 10 drilled in the thrust bearings 9, the holes 11,12,13,14 and channels 29,30 in the leaf plates 6,7 and the tube 15 are large enough to allow passage of 22 gauge wires 16 in sets of 5 or less from the frame 2 side of a door 1 through the hinge 3 to door mounted electrical appliances (only one, a keypad 35, shown) as illustrated in FIG. 2. The round holes 11,13 in the geared leaf plates 6,7 are ⅜ inch in diameter. The channels 29,30 under the leaf plates 6,7 are 5/16 inch wide and 3/32 inch deep. The oval shaped holes 12,14 in leaf plates 6,7 are 3/16 inch×5/16 inch. The tubing 15 with a diameter of 1 inch conceals sets of individual wires 16 from view. The method of producing the entire hinge 3 with the electrical wiring 16 substantially conceals and protects the wiring from the outside of a door 1 mounted in a frame 2 on which the hinge 3 is installed. A typical 84 inch tall door weighing from 200 to 600 pounds requires a heavy duty hinge containing 32 thrust bearings 31 interspersed between gears 8. A typical 84 inch tall door weighing up to 200 pounds requires a standard duty hinge containing 18 thrust bearings 31 interspersed between gears 8. A ¼ inch diameter hole 10 is drilled in from at least 1 to about 3 thrust bearings 9 for passage of electrical wiring 16, the number and location of bearings 9 with holes 10 depending on the number and locations of appliances contained in the door 1. The details of the installed hinge 3 are best shown in FIGS. 2 and 3.

The specifications disclosed herein for the various components of the present invention and associated doors and the frames are illustrative of an especially preferred commercial version of the present invention but are not critical.

Figure 4:
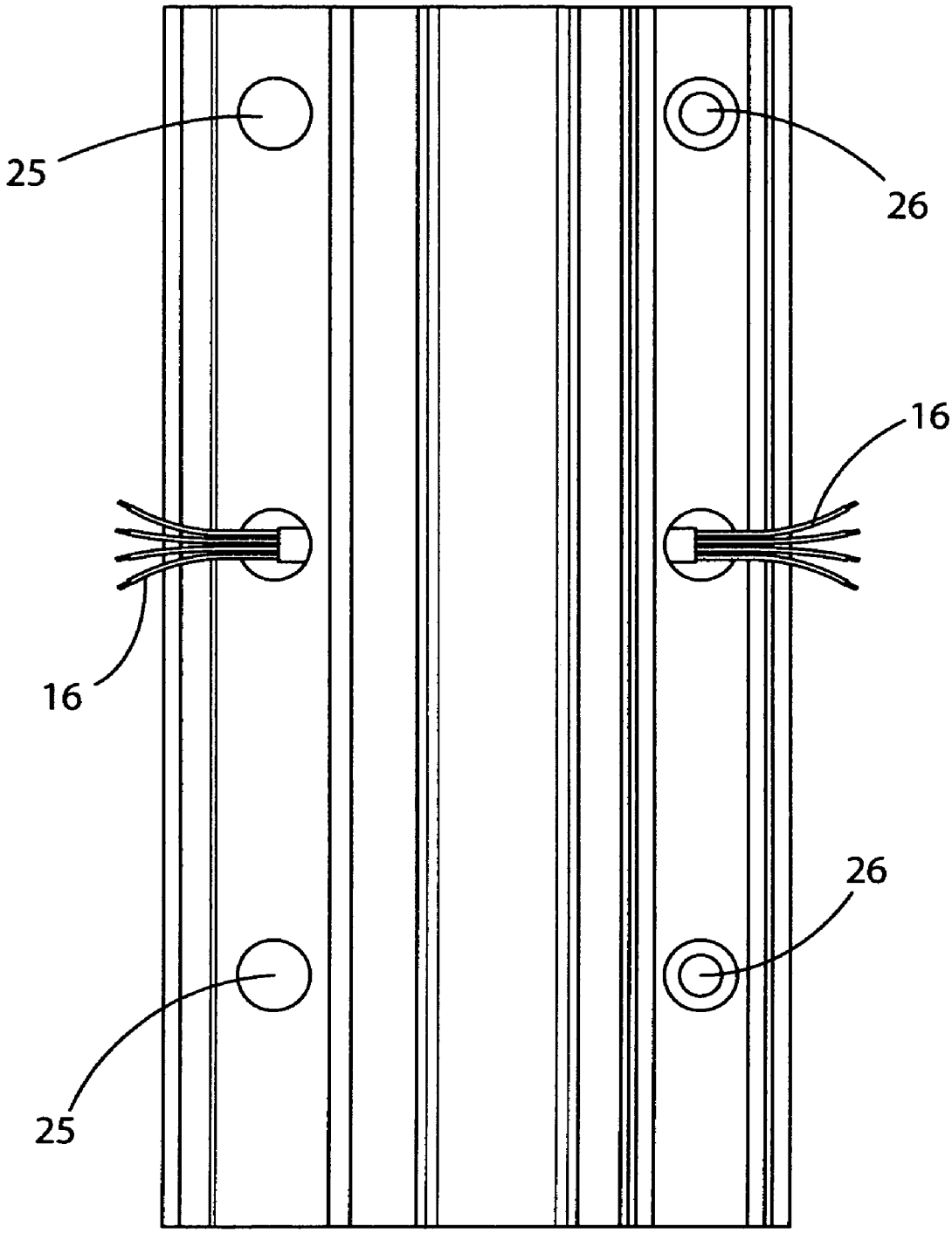
FIG. 4 is a front view of a portion of the uninstalled wired hinge without covers over the holes in the leaf plates.
Figure 5:
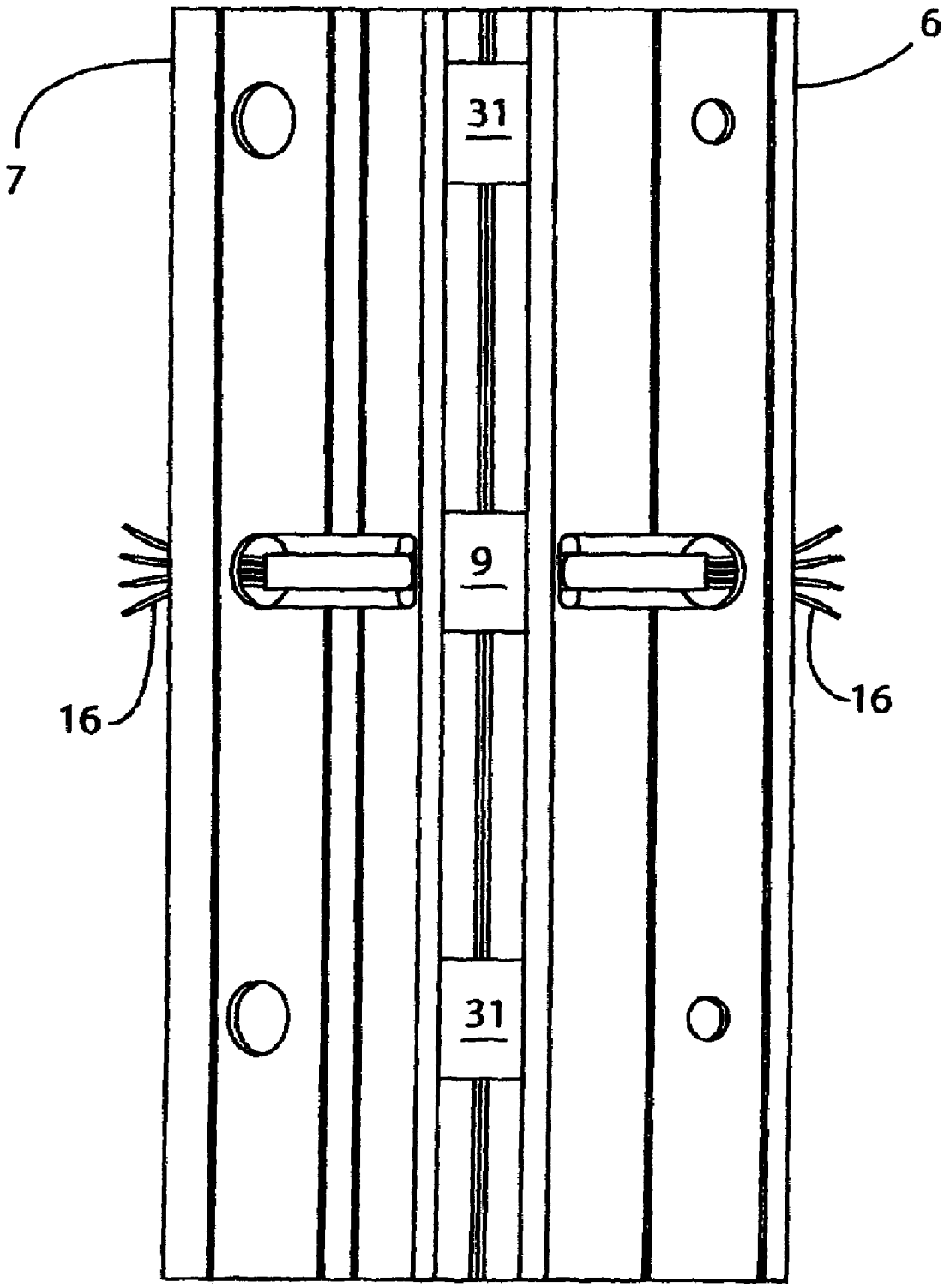
FIG. 5 is a view of a portion of the underside of the uninstalled wired hinge.
Figure 6:
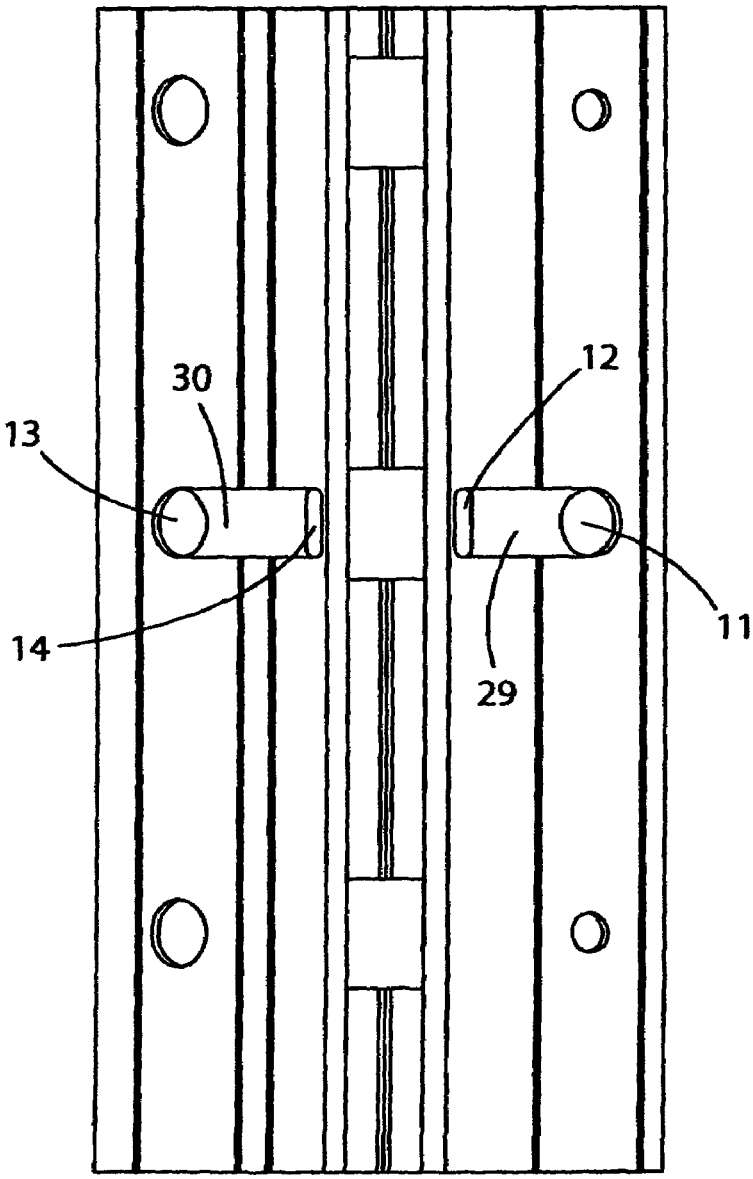
FIG. 6 is a view of the underside of the uninstalled hinge without wiring showing the holes in and channels under the leaves of the hinge.
Figure 7:
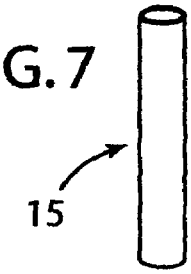
FIG. 7 is a perspective view of the tubing.
Figure 8:
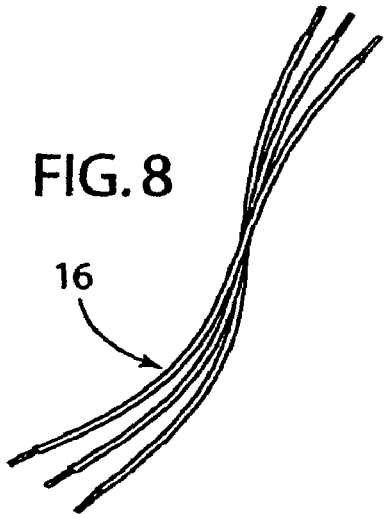
FIG. 8 is a perspective view of the wires.
Figure 9:
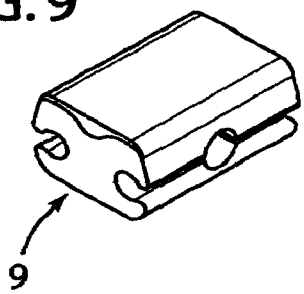
FIG. 9 is a perspective view of a thrust bearing with a hole suitable for passage of the tube containing electric wires.
Figure 10:
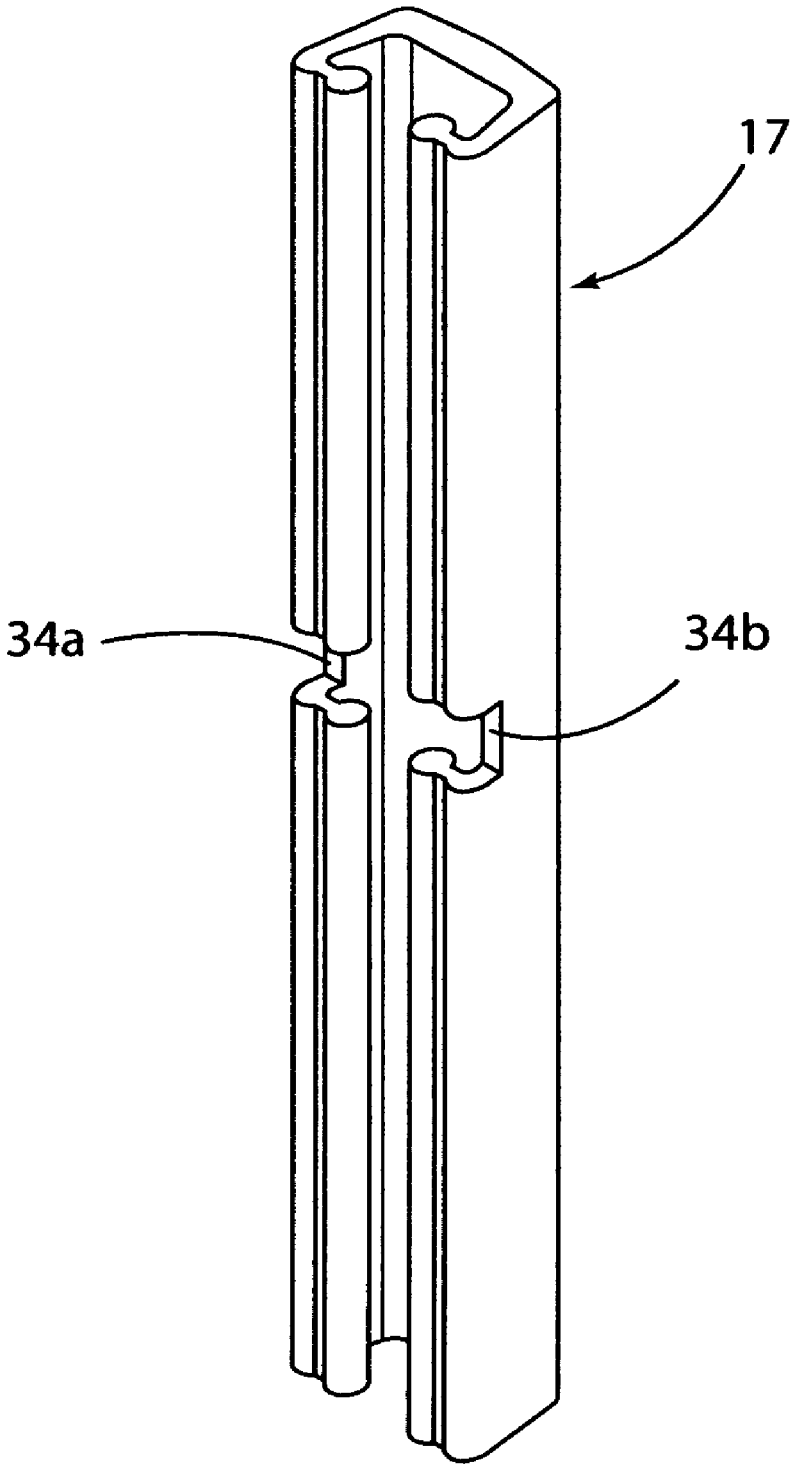
FIG. 10 is a perspective view of the underside of the gear cap showing cutouts for clearing the wiring when the door is rotated a full 180 degrees.
Figure 11:
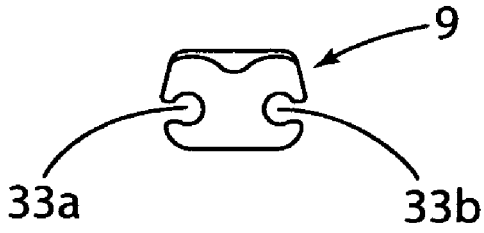
FIG. 11 is a view of the top of a thrust bearing.
Figure 12:
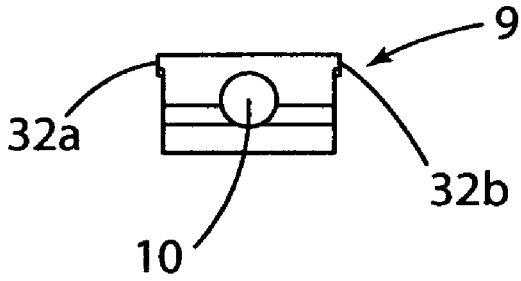
FIG. 12 is a side view of a thrust bearing showing the hole for wiring.
Figure 13:
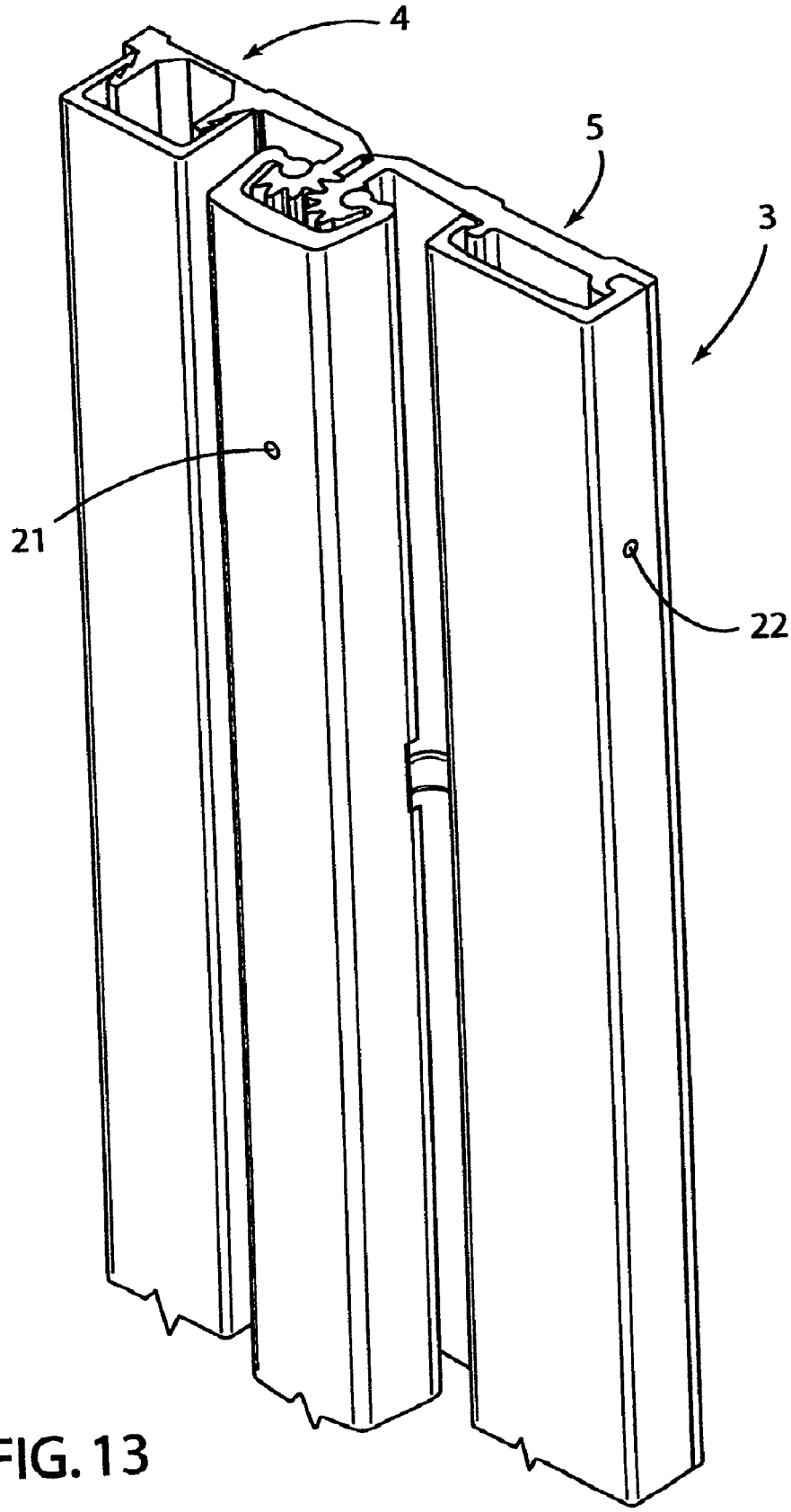
FIG. 13 is a perspective view of a portion of the hinge as it would appear after installation when installed with electrical wiring in place, albeit without the door and the frame.

To prepare the preferred commercial embodiment of the hinge 3 for delivery to an installer, a thrust bearing 9 with a ¼ inch diameter hole 10 replaces a plain bearing 31 that would otherwise be used in the hinge. The bearings 9,31 are preferably composed of hard durable plastic material, such as Valox 310SEO, 0.789 inches long, 0.443 inches high and 0.625 inches wide at its widest dimensions albeit with rounding, projections 32*a*,32*b* and channels 33*a*,33*b* as more clearly shown in FIGS. 11 and 12. Similar channels for the gear cap 17 are also provided in the gears 8 as more clearly evident in FIG. 3. The projections 32*a*,32*b* near the top at each end of the bearings 9, 31 provide a better fit over the ends of adjacent gears 8 when the hinge 3 is assembled. With the covers 18,19 uninstalled a 2¼ inch long ¼ inch diameter round flexible PVC tube 15 is passed through the oval holes 12, 14 in the plates 6,7 and the hole 10 in the bearing 9 by placing the hinge 3 over a fixture that will hold the hinge 3 open at a 120 degree angle and pulling the tube 15 through the hole 10 with needle nose tweezers. As many of 22 gauge wires 16 in sets of 5 or less are routed through the tube 15 in and out of the holes 11,12,13,14 in the leaves 4,5 as required to service the appliances in a door 1. The wires 16 can vary in length but must be long enough to extend far enough out of the round holes 11,13 in the leaves 4,5 to enable the installer to connect them at one end to wires from a power source coming out of a ⅜ inch hole in the frame 2 and at the other end to wires connected to electrical appliances in the door 1 coming out of a ⅜ inch hole in the door face. After the gear cap 17 is installed by sliding it through the channels 33*a*,33*b* provided in the bearings 9,31 and gears 8 and secured with a set screw 21, the tube 15 is inserted and the wires 16 are installed. The clearance slots 34*a*,34*b* on the underside of the cap are 5/16 inch wide×⅛ inch deep. The covers 18,19 over the holes 11,13,25,26 in the leaves 4,5 can be attached to conceal the wire connections after the hinge 3 is installed. A detailed view of the individual components of the hinge 3 is best shown in FIGS. 3-13 while FIGS. 4-5 provide the best view of the wired hinge before installation.

Substantially identical instructions for installing unwired full surface mounted hinges are provided by manufacturers and those instructions are incorporated herein by reference. The wired hinges 3 of the present invention are installed like any other such unwired full surface hinge with the following additional steps:

1) Mark the location in the frame face 1 inch from the frame 2 edge and drill a ⅜ inch hole for the wires.
2) Mark the location in the door face 1⅛ inch from the edge of the door 1 and drill ⅜ inch hole that matches the hole in the frame.
3) Pull wires 16 through the holes in the frame and door faces.
4) Place hinge 3 on frame 2 face and pull wires through the hole 11 in the frame leaf plate 6 lined up with the bearing 9 with a hole 10 for wiring.
5) Attach the hinge 3 to frame 2 and prepare the door 1 in the same way as any other surface hinge.
6) Pull wires 16 through hole 13 in the door leaf plate 7 lined up with the hole 10 in the bearing 9 and then attach the hinge 3 to the door 1. (The hinge 3 is attached with whatever screws and bolts the installer deems appropriate for frame and door involved).
7) Attach wires 16 at both ends to wires from the source of electric current and wires from appliances in door, slide excess wiring into door 1 and frame 2, tape in place in cover channels and install leaf covers 18,19 carefully to avoid pinching wires.

Holes 26 are provided in the frame leaf 4 for screws to fasten the hinge 3 to the frame 2. Holes 25 are also provided in the door leaf 5 to bolt the hinge 3 to the door 1. The frame leaf cover 18 is press fitted over oppositely barbed rails 23*a*,23*b* that, once installed, prevent removal of the cover without actually deforming or destroying it. In contrast, the door leaf cover 19 slides into a channel in one rail 24*b* and pivots over a second rail 24*a* in a removable configuration. A setscrew 22 helps to secure the door leaf cover 19.

In contrast to the Pemko wired hinge, the wiring in the present invention is connected after installation of the hinge itself. The wiring in the Pemko hinge must be connected before installing the hinge. This is accomplished in part by using a bulky connection that increases the chances of pinching the wires when the wiring is covered.

Independent testing has proven that sagging doors refitted with the full surface continuous hinges of the present invention can endure 25 million cycles of door opening and closing equivalent to about 50 years of high traffic use. The wiring in the product of the present invention is warranted for a full 5-years.

The present invention has been described in its preferred embodiments that are not intended to be limiting. Various alterations and modifications will become readily apparent to those skilled in the art after reading the present disclosure. The scope of the present invention should therefore be limited only by the scope of the appended claims.

The invention claimed is:

1. An improvement in a geared full surface continuous door hinge for use on a door equipped with at least one electrical appliance, comprising a) a frame leaf and a door leaf, each leaf having a plate segment and gear segments, said gear segments arranged to mesh with each other and said plate segments having a channel under the plate segments between an outer hole and an inner hole, b) a plurality of thrust bearing segments interspersed between the meshing gear segments with at least one of the thrust bearing segments having a hole aligned with the channels in the plate segments for passage of electrical wiring, c) the electrical wiring long enough to extend i. up through the outer hole of the plate segment of the frame leaf, ii. through the channel under the plate segment of the frame leaf, iii. out through the inner hole of the plate segment of the frame leaf, iv. through the hole in the at least one thrust bearing segment, v. down through the inner hole of the plate segment of the door leaf, vi. through the channel under the plate segment of the door leaf, and vii. up out of the outer hole in the plate segment of the door leaf, d) a flexible tube enclosing said electrical wiring long enough to extend from a position in the channel under the plate segment of the frame leaf to a position in the channel under the plate segment of the door leaf.

2. The improvement of claim 1 wherein the hinge further comprises e) a cap over the gear segments and the bearing segments, f) a first cover over the outer hole in the frame leaf out of which hole the electrical wiring extends ready for connecting to wires from a source of electrical power and g) a second cover over the outer hole in the door leaf out of which hole the electrical wiring extends ready for connecting to the at least one electrical appliance in the door, said cap having cutouts aligned with the hole in the at least one thrust bearing segment to relieve the wiring as the wiring passes from the frame leaf though the hole in the at least one thrust bearing segment to the door leaf.

3. A geared full surface continuous hinge for a door comprising 1. two leaves, each leaf having meshing geared segments and a plate segment extending substantially for the full length of the door,
2. a plurality of thrust bearings interspersed between and interrupting the meshing geared segments of the hinge,
3. a hole through at least one of the thrust bearings aligned with channels under the leaves,
4. two holes in each of the plate segments at each end of said channels, and
5. electric wires enclosed in a flexible tube whereby said holes and channels are aligned permitting the electric wires enclosed in the flexible tube to pass through and under the hinge in and out of the holes in the plate segments and the hole in the at least one bearing and thereby provide a conduit through the hinge for an electric current to pass from connecting electrical wiring in a frame in which the door is mounted to connecting electrical wiring from an electric appliance in the door while remaining substantially concealed to a person outside the door.

4. A combination providing a conduit for electrical wiring through a full surface continuous gear hinge adapted for attachment to a door having an outside surface and a door frame having an outside surface, said hinge having a door leaf and a frame leaf, each leaf having a plate segment and a plurality of meshing geared segments interrupted with thrust bearing segments, said leaves adapted to attach to said outside surfaces and pivot around said thrust bearing segments and meshing geared segments, said combination comprising a. at least one of the thrust bearing segments having a hole aligned with inner and outer holes at each end of channels under the plate segment of the frame and door leaves, said holes and channels allowing the electrical wiring to pass into the outer hole of the frame leaf, through the channel and out of the inner hole of the frame leaf, through the hole in the at least one thrust bearing segment and into the inner hole of the door leaf, through the channel and out the outer hole of the door leaf, b. a cap extending substantially the full length of the hinge and covering and holding the geared and bearing segments of the hinge together while permitting the door to pivot a full 180 degrees with the assistance of cutouts in the cap aligned with the holes and c. a cover extending substantially the full length of the hinge and adapted to substantially conceal and protect the electrical wiring passing into and out of the outer holes in the leaves.

5. The combination of claim 4 further comprising d. said electrical wiring is partially enclosed in a flexible tube, said wiring extending through the hole in the at least one thrust bearing segment and the channels under the leaf plates and out of the outer holes in the leaf plates, said flexible tube extending from the channel under the flame leaf plate out through the hole in the at least one thrust bearing segment down to the channel under the door leaf, e. the cap is removable being secured by a set screw, f. the cover over the wires and the outer hole in the flame leaf plate is non-removable being secured by opposing barbs on rails affixed to the frame leaf plate and g. the cover over the wires and the outer hole in the door leaf plate is removable being secured by a set screw.

6. A geared full surface continuous door hinge for use on a door having at least one electrical appliance, the hinge comprising:

a. a flame leaf and a door leaf, each leaf having a plate segment and gear segments interrupted with thrust bearing segments, said gear segments arranged to mesh with each other;

b. at least one of the thrust bearing segments having a side parallel to the frame leaf, a side parallel to the door leaf, and a hole extending laterally through the at least one thrust bearing segment from the side parallel to the frame leaf to the side parallel to the door leaf, wherein said sides of the at least one thrust bearing segment each include a longitudinally extending channel oriented generally transverse to the hole, the channels slidably receiving a cap; and c. electrical wiring extending up from a hole in the door leaf through the hole in the at least one thrust bearing segment down through a hole in the door leaf segment, such that the hole in the at least one thrust bearing segment acts as a conduit for connecting the electrical wiring from a frame to the door in which the at least one electrical appliance is installed.

* * * * *